United States Patent [19]

Kunreuther

[11] Patent Number: 4,601,417

[45] Date of Patent: Jul. 22, 1986

[54] HOSIERY TAG

[75] Inventor: Steven J. Kunreuther, New York, N.Y.

[73] Assignee: Kunreuther and Beringhause, Franklin Square, N.Y.

[21] Appl. No.: 712,529

[22] Filed: Mar. 18, 1985

[51] Int. Cl.[4] ..... A41G 25/14; B65D 13/00; B65D 85/18

[52] U.S. Cl. ..... 223/85; 206/292; 206/296; 206/477; 206/806

[58] Field of Search ..... 206/278, 281, 299, 283, 206/285, 289, 292, 293, 294, 477, 806, 296, 284; 223/85, 87, DIG. 1, DIG. 2

[56] References Cited

U.S. PATENT DOCUMENTS

| | | | |
|---|---|---|---|
| 2,748,930 | 6/1956 | Power et al. | 206/278 |
| 3,037,621 | 6/1962 | Jackman | 206/294 |
| 3,069,009 | 12/1962 | Hoeflich | 206/284 |
| 3,841,478 | 10/1974 | Wells et al. | 223/87 |
| 4,190,151 | 2/1980 | Russell | 223/87 |
| 4,266,677 | 5/1981 | Dewsnap | 223/87 |
| 4,331,240 | 5/1982 | Vanasse | 206/806 |
| 4,347,930 | 9/1982 | Herrin | 206/806 |
| 4,485,917 | 12/1984 | Smith | 206/278 |

FOREIGN PATENT DOCUMENTS

| | | | |
|---|---|---|---|
| 250232 | 3/1964 | Australia | 223/87 |
| 0052596 | 11/1981 | European Pat. Off. | 206/284 |
| 2331487 | 6/1977 | France | 206/294 |
| 2041744 | 9/1980 | United Kingdom | 211/113 |

*Primary Examiner*—Louis K. Rimrodt
*Assistant Examiner*—Joseph S. Machuga
*Attorney, Agent, or Firm*—James & Franklin

[57] ABSTRACT

The tag includes first and second side portions and an intermediate portion. The side portions are articulately joined to parallel opposite edges of the intermediate portion and are adapted to be aligned in spaced, substantially parallel relation so as to sandwich a folded pair of hosiery therebetween. The top edges of the side portions are inclined with respect to the bottom edges such that the intermediate portion is situated in a plane inclined with respect to the plane containing the bottom edges so as to accommodate the inclined folded portion of the hosiery pair and hang vertically from a hook affixed to the intermediate portion.

1 Claim, 7 Drawing Figures

HOSIERY TAG

The present invention relates to tags for use on hosiery and, more particularly, to a tag for use on hosiery adapted to accommodate the inclined folded portion of hosiery such as a pair of socks.

Hosiery such as men's and boys' socks are often displayed on racks at retail establishments. The socks are mounted on a plastic hanger which, in turn, is suspended from a bar or the like which forms a portion of the display rack. Normally, the socks of the pair are situated in side-by-side relation and then folded at the mid-section such that the top of the socks is aligned with the toes. The thus folded sock pairs are suspended from the plastic hanger by inserting the bar of the plastic hanger under the folded portion.

The use of plastic hangers for suspending sock pairs from a display rack as described above has a major disadvantage in that the sock pairs tend to become dismounted from the hanger during shipment and display. The socks in the pair may then become separated and/or soiled. This problem is aggravated by the fact that when the sock pairs are folded and placed on the hanger, the folded portion is in a plane which is inclined relative to the horizontal, that is, a plane which forms an acute angle with the center line of the remainder of the sock. Thus, if the hanger is horizontal, the socks hang at an angle which is offset with respect to the vertical. This increases the tendency of the socks to dismount from the hanger.

One attempt to circumvent this problem is to affix a hook to the folded sock pair by means of a plastic tag fastener or attachment of the type well known in the art. A tag bearing various information may also be attached to the socks in the same operation, either on the same side or on the opposite side of the socks from the hook. This technique eliminates the problem of the socks dismounting from the hook, but has the drawback of requiring a rather complicated mounting operation. If done manually, the socks, hook and tag must be appropriately aligned as the tag attaching gun penetrates same. If automated equipment is utilized, separate feed means are required for the hook and tag and a fairly complicated control mechanism must be employed.

Another attempt to overcome the above deficiencies utilizes a piece of cardboard which is folded over itself such that it appears as an upside-down "V" in end view. A hook protrudes through an opening along the fold line. Each of the sides of the folded cardboard is provided with an aligned slit. The sock pairs are inserted through the slits and then folded such that the sides of the cardboard are adjacent to each other with the socks hanging down from the cardboard. The folded socks mounted in this manner keep the sides adjacent to each other. In some instances, the slit through which the folded socks extend has been made at an angle inclined with respect to the horizontal so as to accommodate the incline of the sock fold.

This method of tagging hosiery suffers from the disadvantages of both of the above-described methods. Since the socks are not affixed to the tag by a fastener or the like, the possibility of the socks being dismounted exists, although it is somewhat less than when a plastic hanger is used alone. In addition, as with the separate hook and tag method, the mounting operation is complicated and time-consuming, thus not cost effective.

It is, therefore, a prime object of the present invention to provide a hosiery tag which overcomes the above problems.

It is another object of the present invention to provide a hosiery tag which accommodates the inclined folded portion of hosiery such as a pair of socks.

It is another object of the present invention to provide a hosiery tag which is situated on both sides of the folded pairs of socks such that identifying indicia can be viewed from either side.

It is another object of the present invention to provide a hosiery tag which incorporates a hook for mounting on a display rack.

It is another object of the present invention to provide a hosiery tag which can be easily affixed to the hosiery with a single plastic fastener.

It is another object of the present invention to provide a hosiery tag and hook combination which can be mounted to a pair of socks in a simple, easy, and efficient manner.

It is another object of the present invention to provide a hosiery tag and hook combination which can be manufactured at relatively small cost.

In accordance with one aspect of the present invention, a tag is provided for use on hosiery or the like. The tag comprises a first portion, a second portion, and an intermediate portion. The intermediate portion has first and second opposite edges spaced from each other. Each of the first and second portions is articulately joined to a different one of the edges and adapted to be aligned in spaced, substantially parallel relation. Each of the portions comprises a first edge joined to the intermediate portion edge and a second edge remote from the intermediate portion edge. Each of the first edges is at an incline with respect to the second edges.

The opposite edges of the intermediate portion are preferably substantially parallel. In fact, the intermediate portion is preferably substantially rectangular.

Each of the first and second portions has a center line. Each of the center lines forms an acute angle with a different one of the opposite edges of the intermediate portion.

The intermediate portion preferably comprises means for mounting a hook. Each of the first and second portions preferably comprises a fastener receiving opening. Preferably, the fastener receiving openings are adapted to be aligned.

In accordance with a second aspect of the present invention, a tag is provided for use on hosiery or the like. The tag comprises first and second portions, each having substantially parallel side edges. A bottom edge is provided substantially perpendicular to the side edges. A top edge is provided at an incline with respect to the bottom edge. Means are provided for hingeably connecting the top edges.

The connecting means preferably comprises a substantially rectangular connecting portion. The connecting means comprises means for mounting a hook.

Preferably, each of the first and second side portions has a fastener receiving opening. The fastener receiving openings are adapted to be situated in alignment.

In accordance with a third aspect of the present invention, a tag is provided for use on hosiery or the like. The tag comprises first and second side portions adapted to be situated in spaced, substantially parallel aligned relation with the bottom edges thereof in substantially the same plane. A top portion is provided. The top portion is articulately mounted to the side portions in a plane which is inclined relative to the plane of the bottom edges of the side portions.

The top portion preferably comprises means for mounting a hook. Fastener receiving openings are preferably provided on the side portions. The fastener receiving openings are adapted to be aligned.

To these and to such other objects which may hereinafter appear, the present invention relates to a hosiery tag, as described in detail in the following specification and recited in the annexed claims, taken together with the accompanying drawings, wherein like numerals refer to like parts and in which:

Figure 6:
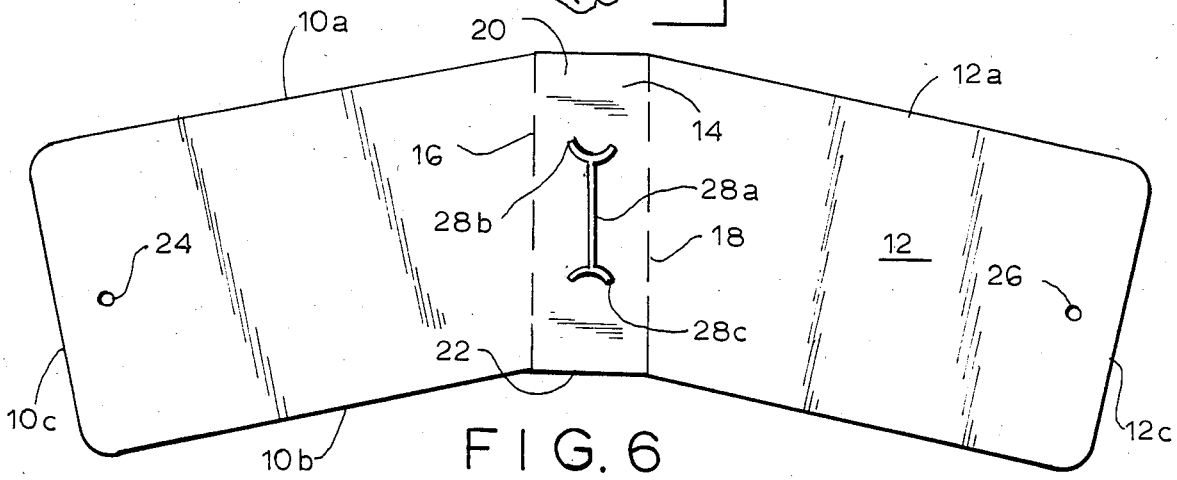
FIG. 6 is a top plan view of the hosiery tag of the present invention.

As best seen in FIG. 6, the hosiery tag of the present invention comprises a single sheet of thick paper or thin cardboard which is divided into first and second side sections 10 and 12, and an intermediate section 14 by a pair of parallel fold lines 16, 18. Intermediate section 14 is substantially rectangular, being defined by parallel fold lines 16 and 18, a front edge 20, and a rear edge 22. The front and rear edges 20 and 22 are also substantially parallel.

Each of the side sections 10 and 12 has a front edge 10*a*, 12*a*, a rear edge 10*b*, 12*b*, and a bottom edge 10*c*, 12*c*. The front and rear edges 10*a*, 10*b*, and 12*a*, 12*b* of each of the side portions 10 and 12 are substantially parallel to each other. Bottom edges 10*c* and 12*c* are substantially perpendicular to the front and rear edges 10*a*, 10*b* and 12*a*, 12*b*, respectively.

The front edges 10*a* and 12*b* are not, however, colinear with the front edge 20 of intermediate section 14, as with a conventional header or the like, but, instead, are inclined with respect to edge 20 in opposite directions. Accordingly, the center line of each of the side sections 10, 12 forms an acute angle with fold lines 16 and 18 and if the center lines were extended to meet, same would form an obtuse angle. Since bottom edges 10*c* and 12*c* are perpendicular to the side edges, they are inclined relative to folds 16 and 18.

Each of the side portions 10 and 12 is provided with an opening 24, 26 to receive a fastener therein, as described below. In addition, intermediate section 14 is provided with a slit 28 along the center thereof in order to receive a plastic hook, as described below. Slit 28 includes an elongated central portion 28*a* and a pair of semicircular side portions 28*b* and 28*c* which facilitate the opening of central portion 28*a* such that the hook can be received therein.

Figure 4A:
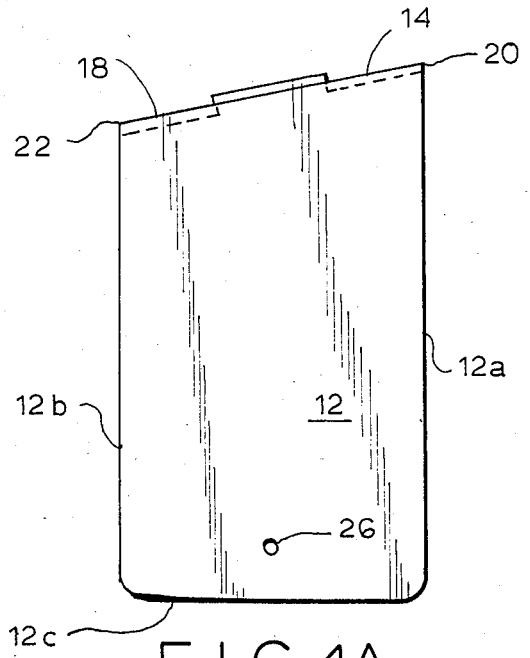
FIG. 4A is a side view of the hosiery tag of the present invention.
Figure 4B:
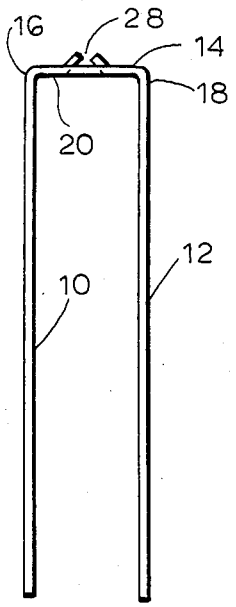
FIG. 4B is a front view of the hosiery tag of the present invention.

As best seen in FIGS. 4A and 4B, side portions 10 and 12 are adapted to be folded along fold lines 16 and 18 into a generally parallel spaced configuration so as to receive a sock pair therebetween. In this manner, identifying indicia, such as product type, price, etc., can be printed on the surfaces of side portions 10 and 12 and will be visible from both sides of the assembly.

As can be clearly seen in FIG. 4A, when side portions 10 and 12 are folded into parallel relation, intermediate portion 14 is situated in a plane which is inclined with respect to the plane which contains the bottom edges 10*c* and 12*c*.

Figure 3:
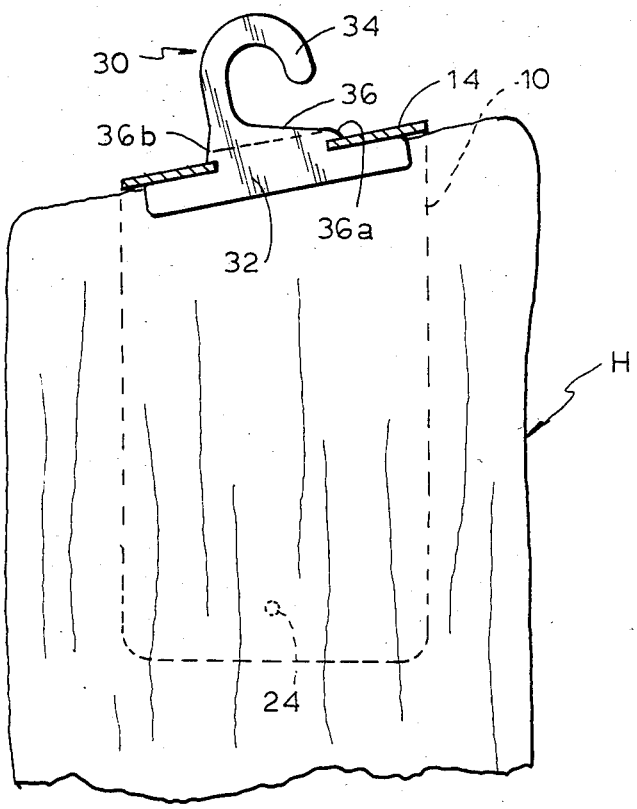
FIG. 3 is a fragmentary side view taken along line 3—3 of FIG. 2.
Figure 5:
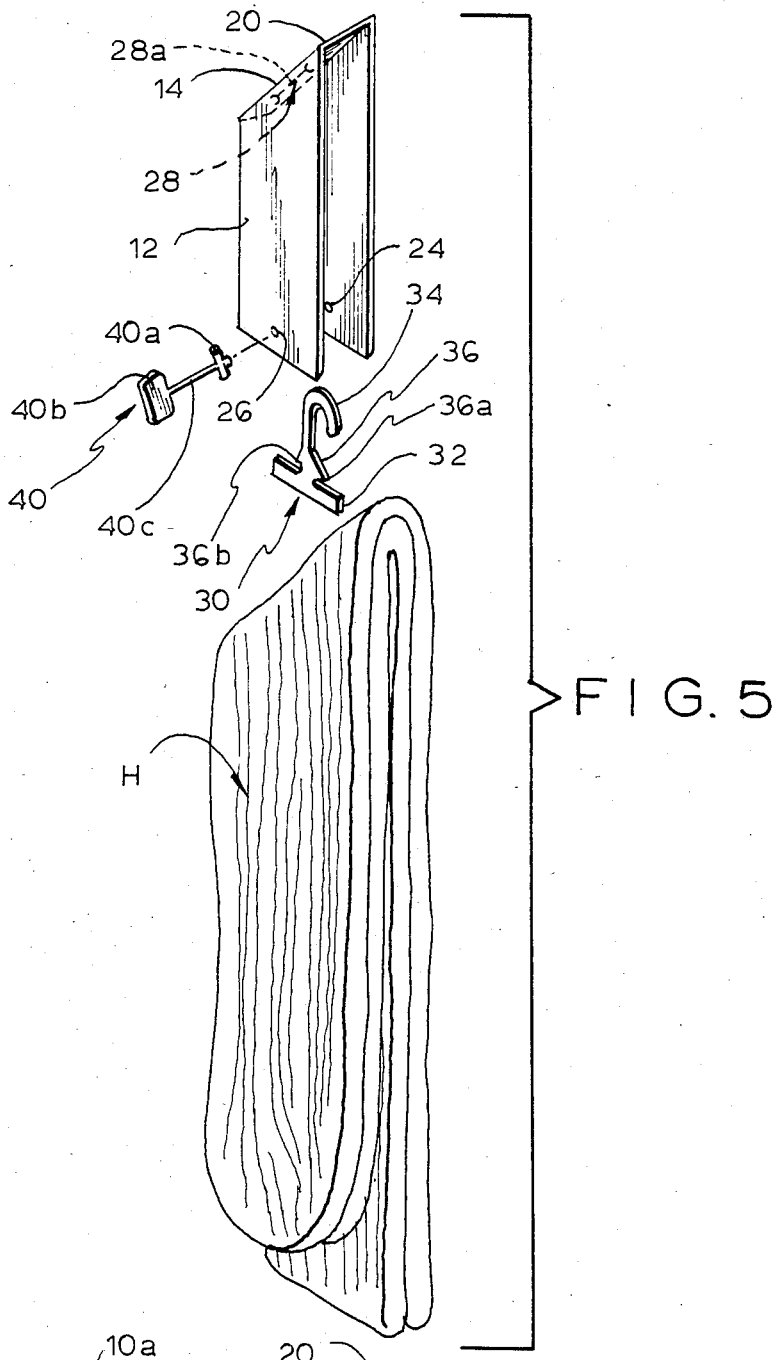
FIG. 5 is an exploded isometric view of the hosiery tag of the present invention and a pair of socks.

As best seen in FIG. 5, prior to mounting on a pair of folded socks H, a plastic hook, generally designated 30, is received within slit 28. Plastic hook 30 comprises an elongated base part 32 and a hook part 34. Between base part 32 and hook part 34 is a part 36 which has an inclined upper surface to cam the flaps which form slit 28 apart such that the flaps which form either end of slit 28 can lodge beneath the protruding front and rear extensions 36*a* and 36*b*, as best seen in FIG. 3.

It should be appreciated that hook 30 can be mounted on the tag by simply inserting the hook part 34 through slit 28 and pulling upwards. The flaps which define the ends of slit 28 lodge under extensions 36*a* and 36*b* and maintain the hook in the proper position relative to the tag.

Figure 1:
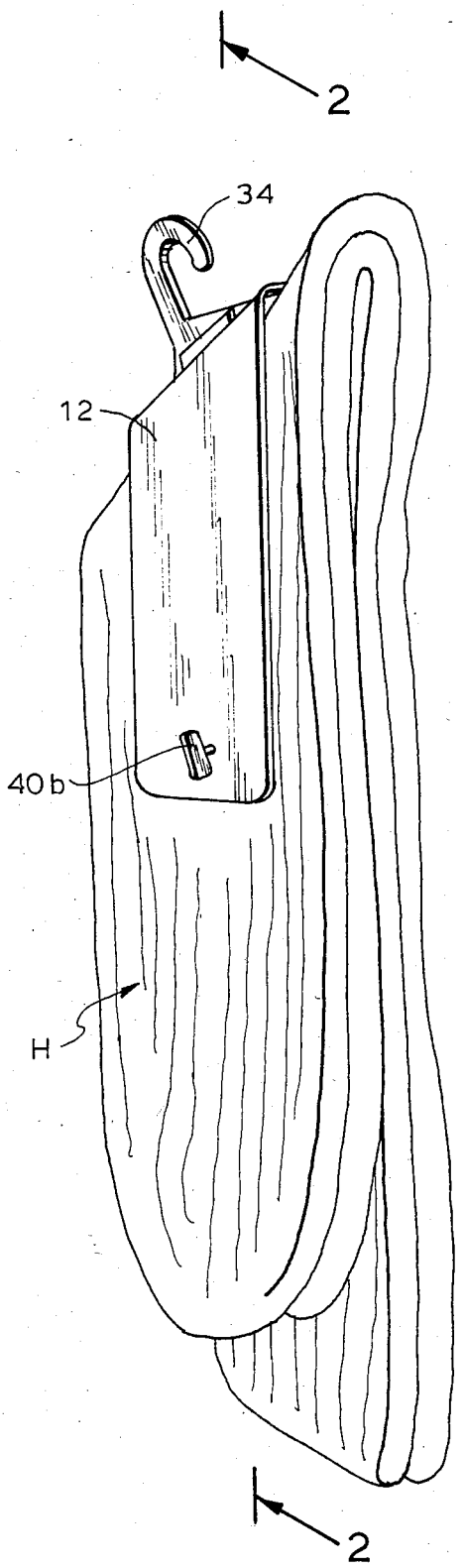
FIG. 1 is an isometric view showing the hosiery tag of the present invention mounted on a pair of socks.
Figure 2:
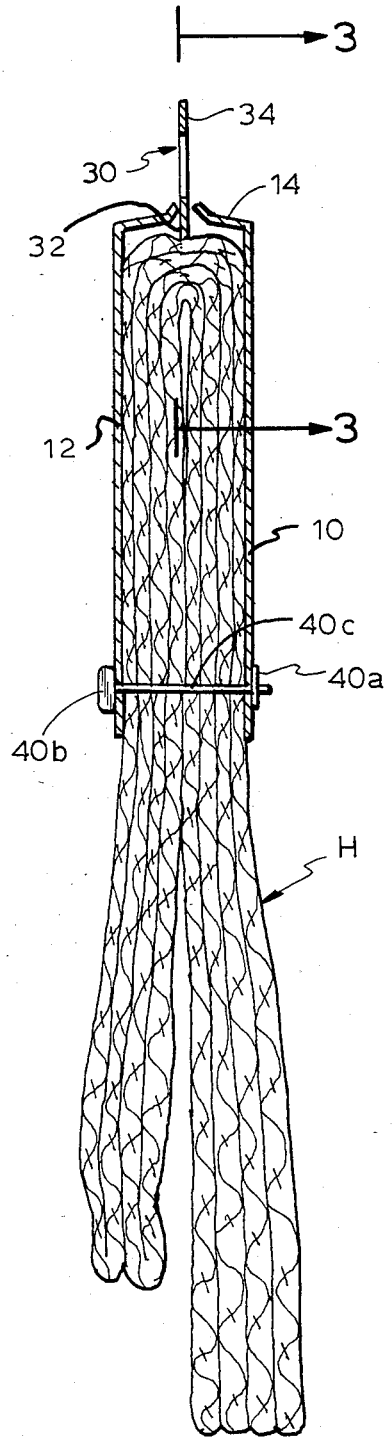
FIG. 2 is a cross-sectional view taken along line 2—2 of FIG. 1.

After the hook is inserted into slit 28, the tag is placed over the folded sock H. A plastic fastener, generally designated 40, of conventional design, is inserted then through aligned holes 24 and 26. In this manner, the tag is affixed to the socks, as illustrated in FIGS. 1 and 2, and cannot be removed unless fastener 40 is cut.

Fastener 40 has a T-bar end 40*a* and a paddle end 40*b* connected by a thin filament 40*c*. As is best seen in FIG. 2, when fastener 40 is mounted in the proper position, the T-bar end 40*a* is situated on the exterior surface of side portion 10 while the paddle end 40*b* is situated adjacent the exterior surface of side portion 12. The connecting filament portion 40*c* extends between the T-bar end 40*a* and the paddle end 40*b*, maintaining the side portions 10 and 12 in a generally parallel spaced condition such that the folded pair of socks is securely held between the side portions.

As will be appreciated from FIG. 3, when the socks are folded in the manner illustrated, the plane of the top edge of the socks, along the fold, is not perpendicular with the vertical center line of the socks but, instead, forms an acute angle therewith. That is, the plane is inclined with respect to the horizontal. Hook part 34 and fastener receiving holes 24 and 26 are situated generally along the vertical center line of the socks. Thus, if intermediate portion 14 were not suitably inclined, the socks would not hang vertically on the display rack. In order to overcome this problem and provide a snug fit along the inclined fold of the socks, the hosiery tag of the present invention is structured such that the incline of the intermediate portion is generally parallel to the incline of the fold of the socks.

It will therefore be appreciated that the present invention is a tag for use on hosiery or the like. The tag includes a first portion 10, a second portion 12 and an intermediate portion 14. The intermediate portion has first and second opposite edges 16 and 18 which are spaced from each other. Each of the first and second portions 10 and 12 is articulately joined to a different one of the spaced edges 16, 18. The portions 10 and 12 are adapted to be aligned in spaced, substantially parallel relation. Each of the portions 10 and 12 includes a first edge joined to the intermediate portion 14 along one of the fold lines 16 and 18, and a second edge 10*c* or 12*c* which is remote from the intermediate portion edge. Edges 10*c*, 16 and 12*c*, 18 are inclined with respect to each other such that the center lines of each of the portions 10 and 12 meet the fold lines 16 and 18 at an acute angle. Because the intermediate portion 14 is substantially rectangular, it will be inclined with respect to the horizontal when mounted on the socks. The intermediate portion 14 has a slot 28 adapted to receive a hook 30 therein. The portions 10 and 12 are also provided with fastener receiving openings 24 and 26 which are adapted to be aligned when the portions 10 and 12 are situated in spaced parallel relation.

Portions 10 and 12 have substantially parallel front and rear edges 10*a*, 10*b* and 12*a*, 12*b*, respectively. Each portion has a bottom edge 10*c*, 12*c* which is substantially perpendicular to the front and rear edges. Top edge 16, 18 is inclined with respect to the bottom edges 10*c*, 12*c*. Means are provided for hingeably connecting the top edges 16 and 18. The connecting means preferably comprises a substantially rectangular intermediate portion 14. The intermediate portion 14 comprises a means for mounting the hook 30.

When mounted on a pair of hosiery, edges 10*c* and 12*c* are substantially coplanar and the intermediate portion, which is articulately mounted to the side portions, is in a plane which is inclined relative to the plane of edges 10*c* and 12*c*.

While only a single preferred embodiment of the present invention has been disclosed herein for purposes of illustration, it is obvious that many variations and modifications could be made thereto. It is intended to cover all of these variations and modifications which fall within the scope of the present invention, as defined by the following claims:

I claim:

1. A tag for use in conjunction with hook means of the type having an enlarged base part and a hook part and with a fastener of the type having an elongated filament with enlarged ends, the tag being adapted to display vertically hanging hosiery folded along a line substantially inclined with respect to the horizontal, said tag comprising first and second side portions and an intermediate portion, each of said side portions having first and second edges, said second edges of said side portions being inclined with respect to said first edges thereof, said intermediate portion being articulately joined between said inclined second edges of said side portions, said side portions being adapted to be situated in spaced, substantially parallel relation with the hosiery therebetween, said intermediate portion having an opening therein adapted to receive the hook means with the base part thereof below said intermediate portion and the hook part thereof extending above said intermediate portion, fastener receiving openings in each of said side portions adapted to align with said side portions and situated in said relation such that a fastener can extend through said fastener receiving openings and the hosiery therebetween, said fastener receiving openings and said hook means receiving openings being substantially vertically aligned, the hosiery hanging substantially vertically with said intermediate portion extending at an incline with respect to the horizontal, in substantially parallel adjacent relation to the hosiery fold line.

* * * * *